US007549238B2

(12) United States Patent
Patakos

(10) Patent No.: US 7,549,238 B2
(45) Date of Patent: Jun. 23, 2009

(54) REVERSIBLE HYGIENE SHOE

(76) Inventor: Nikolaos D. Patakos, 1 Larch Dr., Monmouth Junction, NJ (US) 08852

( * ) Notice: Subject to any disclaimer, the term of this patent is extended or adjusted under 35 U.S.C. 154(b) by 362 days.

(21) Appl. No.: 11/340,961

(22) Filed: Jan. 26, 2006

(65) Prior Publication Data

US 2007/0137069 A1 Jun. 21, 2007

Related U.S. Application Data

(60) Provisional application No. 60/751,931, filed on Dec. 21, 2005.

(51) Int. Cl.
*A43B 3/24* (2006.01)

(52) U.S. Cl. ..... 36/100; 36/101; 36/113

(58) Field of Classification Search ..... 36/100, 36/101, 113, 54, 72 B, 56
See application file for complete search history.

(56) References Cited

U.S. PATENT DOCUMENTS

| | | | | | |
|---|---|---|---|---|---|
| 628,164 | A * | 7/1899 | See | 36/56 |
| 944,424 | A * | 12/1909 | Ferry | 223/113 |
| 1,042,870 | A * | 10/1912 | Benninghaus | 36/56 |
| 2,409,813 | A * | 10/1946 | Timson | 36/99 |
| 2,732,065 | A * | 1/1956 | Marchese | 206/390 |
| 3,120,711 | A * | 2/1964 | Scholl | 36/9 R |
| 3,949,493 | A | 4/1976 | Rhee | 36/2 R |
| 4,103,437 | A | 8/1978 | Dillard | 36/2 R |
| 4,246,707 | A * | 1/1981 | Pedersen | 36/100 |
| 4,361,912 | A | 12/1982 | Arthur | 2/18 |
| 4,361,970 | A | 12/1982 | Wren, Jr. et al. | 36/106 |
| 4,769,928 | A | 9/1988 | Ward | 36/114 |
| 4,972,609 | A | 11/1990 | Oh et al. | 36/2 R |
| 5,211,672 | A | 5/1993 | Andujar | 36/106 |
| 5,381,610 | A * | 1/1995 | Hanson | 36/100 |
| 5,465,507 | A * | 11/1995 | Schumacher et al. | 36/30 R |
| 5,822,888 | A * | 10/1998 | Terry | 36/100 |
| 6,470,600 | B1 | 10/2002 | Louie | 36/113 |
| 2004/0045196 | A1 * | 3/2004 | Shepherd | 36/114 |

* cited by examiner

*Primary Examiner*—Ted Kavanaugh
(74) *Attorney, Agent, or Firm*—Porzio, Bromberg & Newman

(57) ABSTRACT

The present invention relates to a hygiene shoe for martial arts. The hygiene shoe is formed of a form-fitting stretchable material such as neoprene, covered by a flexible fabric on the outside and inside. An outer portion of the hygiene shoe can be formed of a first color selected to match a first belt level of martial arts and an inner portion of the hygiene shoe can be formed of a second color to match a second belt level of martial arts. The hygiene shoe is reversible for preference of the color to be worn and for extending the life of the shoe. A traction portion on the sole of the hygiene shoe comprising a first circular portion beneath the ball of the foot and a second circular portion beneath the heel of the foot connected by connecting portion beneath the outside edge of the foot provides forward movement, pivoting on the ball and heel of the foot and lateral stability.

26 Claims, 8 Drawing Sheets

10
20
28
18
21
29
33
12
27
16
$H_1$
14
37
39
33
27

74a
76
74b 71
70
73
72

REVERSIBLE HYGIENE SHOE

CROSS REFERENCE TO RELATED APPLICATION

This application claims the benefit of U.S. Provisional Patent Application No. 60/751,931, filed Dec. 21, 2005, the entirety of which is hereby incorporated by reference into this application.

BACKGROUND OF THE INVENTION

1. Field of the Invention

This invention relates to a reversible hygiene shoe to be worn during indoor practice of martial arts.

2. Description of Related Art

Protective shoes for martial art sports are known. For example, U.S. Pat. No. 3,949,943 disclose a shoe comprising a casing containing an energy-absorbent soft resilient material substantially open at the bottom. The casing is formed of a plastic material. Straps are provided for aiding the retention and for tightening the shoe on the foot of the wearer.

U.S. Pat. No. 4,972,609 disclose a protective shoe upper and an elastic strap which is partially wrapped around the shoe. The shoe is made of resilient plastic foam covered with a vinyl coating.

U.S. Pat. No. 4,769,928 disclose a shoe and sole to provide traction during martial arts practices and which allows the shoe to be worn for normal day-to-day use.

U.S. Pat. No. 5,211,672 disclose a protective shoe formed of a sponge based upper member. A sole member includes an enclosed toe portion and arch portion and defining an open heel area and open ball of foot area. The sole is constructed of nylon reinforced vinyl.

The above-described patents have the disadvantages that they are formed of a rigid material or have a rigid sole with a hard heel that can result in injury to other practitioners and can track dirt and cause scuff marks into the workout area.

One problem in the martial arts industry is a hygiene issue created by the traditional bare foot practice and conventional shoes which have no bottom. For example, the hygiene problem can include warts, sweat, dirty toenails, odor, skin transmitted diseases and the like. Also, many practitioners do not want their feet and toes exposed for aesthetic purposes and fear of injury.

It is desirable to provide a hygiene shoe to address the above-described shortcomings.

SUMMARY OF THE INVENTION

The present invention relates to a hygiene shoe for martial arts. The hygiene shoe is formed of a form-fitting stretchable material such as neoprene, covered by a flexible fabric on the outside and inside. An outer portion of the hygiene shoe can be formed of a first color selected to match a first belt level of martial arts and an inner portion of the hygiene shoe can be formed of a second color to match a second belt level of martial arts. The hygiene shoe is reversible for preference of the color to be worn and for extending the life of the shoe. A traction portion on the sole of the hygiene shoe comprising a first circular portion beneath the ball of the foot and a second circular portion beneath the heel of the foot connected by connecting portion beneath the outside edge of the foot provides forward movement, pivoting on the ball and heel of the foot and lateral stability. The traction portion is provided on both the inside and outside portion of the hygiene shoe.

The hygiene shoe can be used to keep the toes warm. The hygiene shoe can also be used in combination with martial arts sparing equipment in which the sparing equipment is placed over hygiene shoe without removal of the hygiene. shoe from the foot. The hygiene shoe is also washable.

For safety consideration, the hygiene shoe has no heel or hard sole, no buttons, no sharp edges, no hard stitching and no grommets. Accordingly, wearing of the hygiene shoe create a safer than barefoot experience. The hygiene shoe protects one's feet during board breaking from scratches. The hygiene shoe also keeps a user's toes together so at not to jam them or have them caught in the martial arts mats resulting in sprains, and protecting other practitioners from scratches and cuts by the toenails. The hygiene shoe can increase the enrollment of martial arts students that have the above-mentioned concerns and change the practice as we know it for the best. Additionally, since the hygiene shoe will only be worn indoors, the hygiene shoe will keep the martial arts mats considerably cleaner and odor free.

The invention will be more fully described by reference to the following drawings.

DETAILED DESCRIPTION

Figures 1, 9A, 9B:
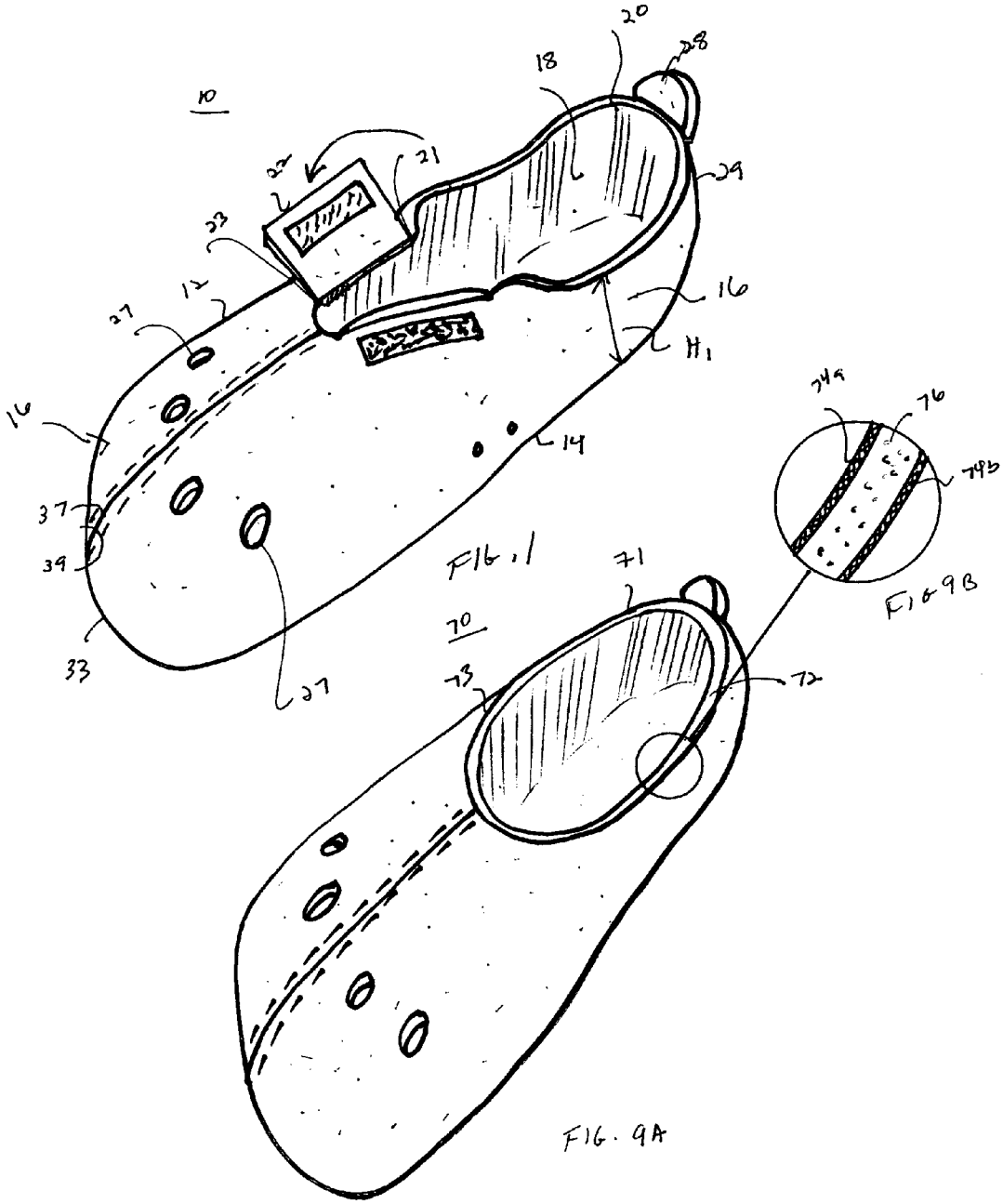
FIG. 1 is a side and top elevational view of the hygiene shoe in an open configuration in accordance with the teachings of the present invention.
FIG. 9A is a side and top elevational view of an alternate embodiment of the hygiene shoe.
FIG. 9B is a perspective view of a restraining band used in the hygiene shoe shown in FIG. 9A.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic view of hygiene shoe 10. Hygiene shoe 10 comprises upper portion 12 and sole portion 14. Hygiene shoe 10 is reversible such that outer portion 16 can be pushed inside inner portion 18 until outer portion 16 becomes the inner portion of hygiene shoe 10 and the inner portion 18 becomes the outer portion of hygiene shoe 10.

In one embodiment, outer portion 16 is formed of a first color and inner portion 18 is formed of a second color. The first color can be selected to match the color of a first belt level of martial arts, for example, a yellow belt, and the second color can be selected to match a second belt level of martial arts, for example, a red belt. Accordingly, the user can wear hygiene shoe 10 with outer portion 16 showing or reverse hygiene shoe 10 with inner portion 18 showing to match a belt level of martial arts which the user is currently practicing.

Opening 20 is formed in upper portion 12 for receiving a foot of a user. Opening extension 21 extends from opening 20 to provide ease of insertion of a foot of the user into opening 20. Flap 22 extends from side 23 of opening extension 21. Attachment member 26 extends from side 25 on the opposite side of opening extension 21. For example, attachment member 24 and attachment member 26 can be formed of a hook and loop material.

Figure 2:
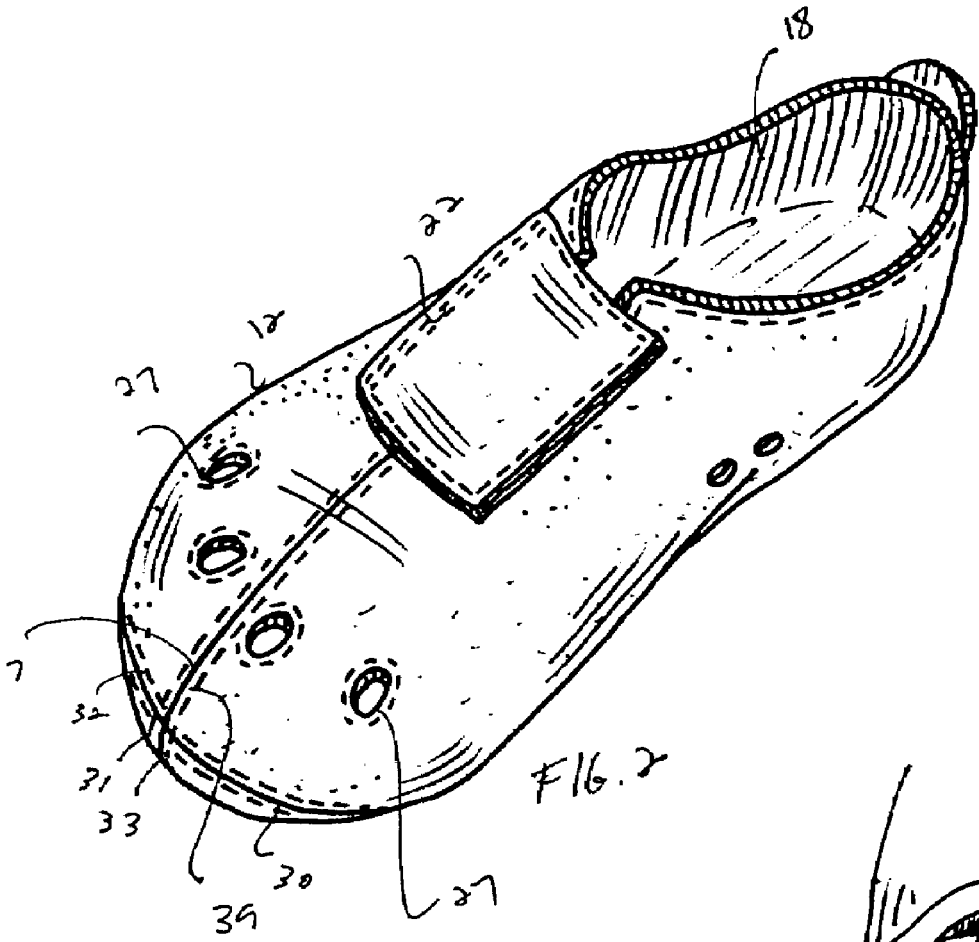
FIG. 2 is a side and top elevational view of the hygiene shoe in a closed configuration.
Figure 3:
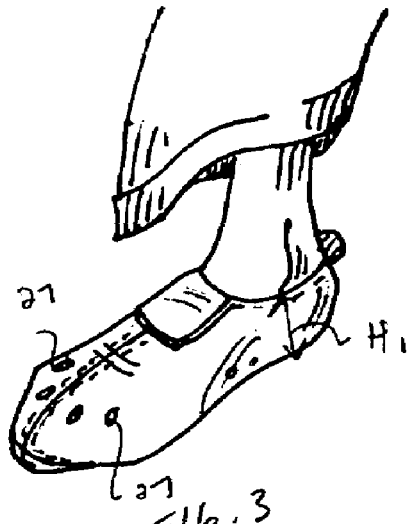
FIG. 3 is a schematic diagram of the hygiene shoe during use.

Flap 22 can be closed for attaching attachment member 24 to attachment member 26, as shown in FIG. 2. During use, flap 22 is opened to allow insertion of a user's foot into opening 20. Thereafter, flap 22 is closed to secure hygiene shoe 10 to the user's foot, as shown in FIG. 3. Upper portion 12 can have a height of $H_1$ sufficient for covering the ankle when hygiene shoe 10 is in use.

Referring to FIG. 1, holes 27 can be formed at predetermined locations in upper portion 12. Holes 27 can be used for ventilation and cosmetic appearance of hygiene shoe 10. Tab 28 can be formed at rear 29. During use, tab 28 can be grasped to pull hygiene shoe 10 on to a user's foot.

Figure 4:
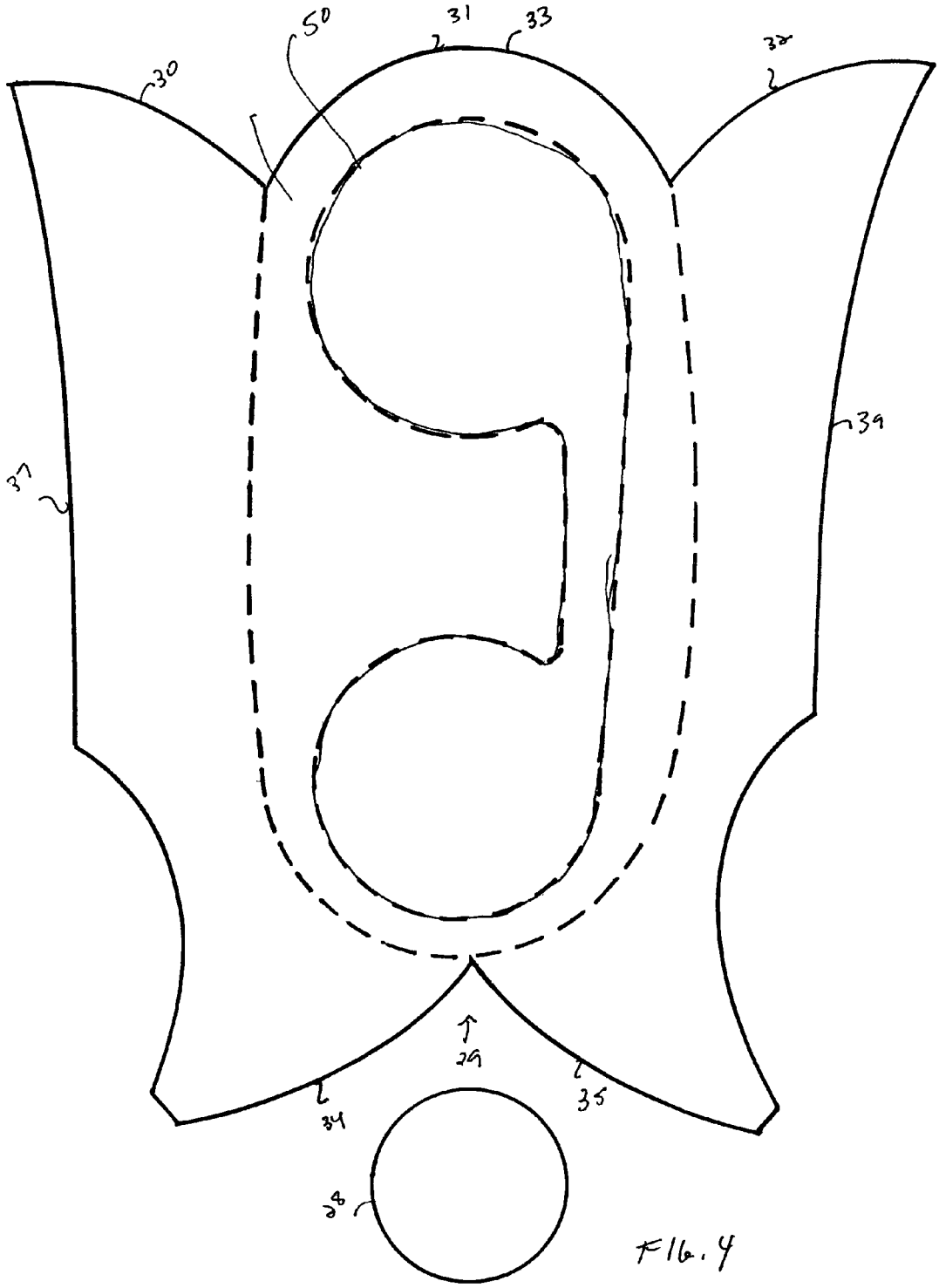
FIG. 4 is a plan view of a one piece construction of the hygiene shoe laid out flat before being assembled together to form the hygiene shoe.
Figure 5:
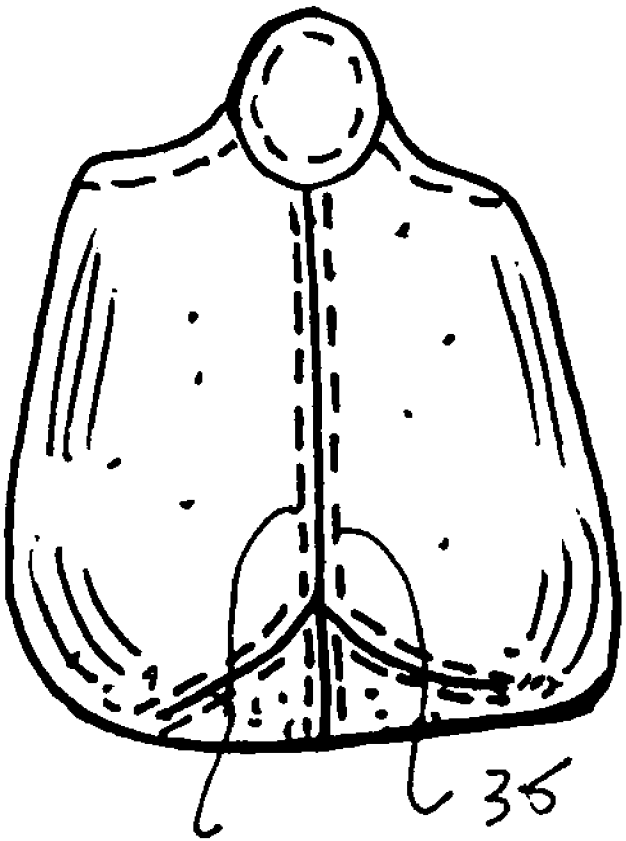
FIG. 5 is a rear elevational view of the hygiene shoe.

In one embodiment, hygiene shoe 10 is formed of a single piece of material, as shown in FIG. 4. Upper portion 12 and sole portion 14 are formed integral to one another. Respective edge portion 30, edge portion 31, and edge portion 32 can be attached to one another to form front 33 of hygiene shoe 10. Edge portion 34 and edge portion 35 can be attached to one another to form rear 29 of hygiene shoe 10. Edge portions 37 and edge portion 39 can be attached to one another to form upper portion 12 of hygiene shoe 10. For example, each of the respective edge portions can be attached to each other with stitching, as shown in FIGS. 1 and 5. Tab 28 can be attached to rear 29 of hygiene shoe 10 with stitching as shown in FIG. 1.

Figure 6A:
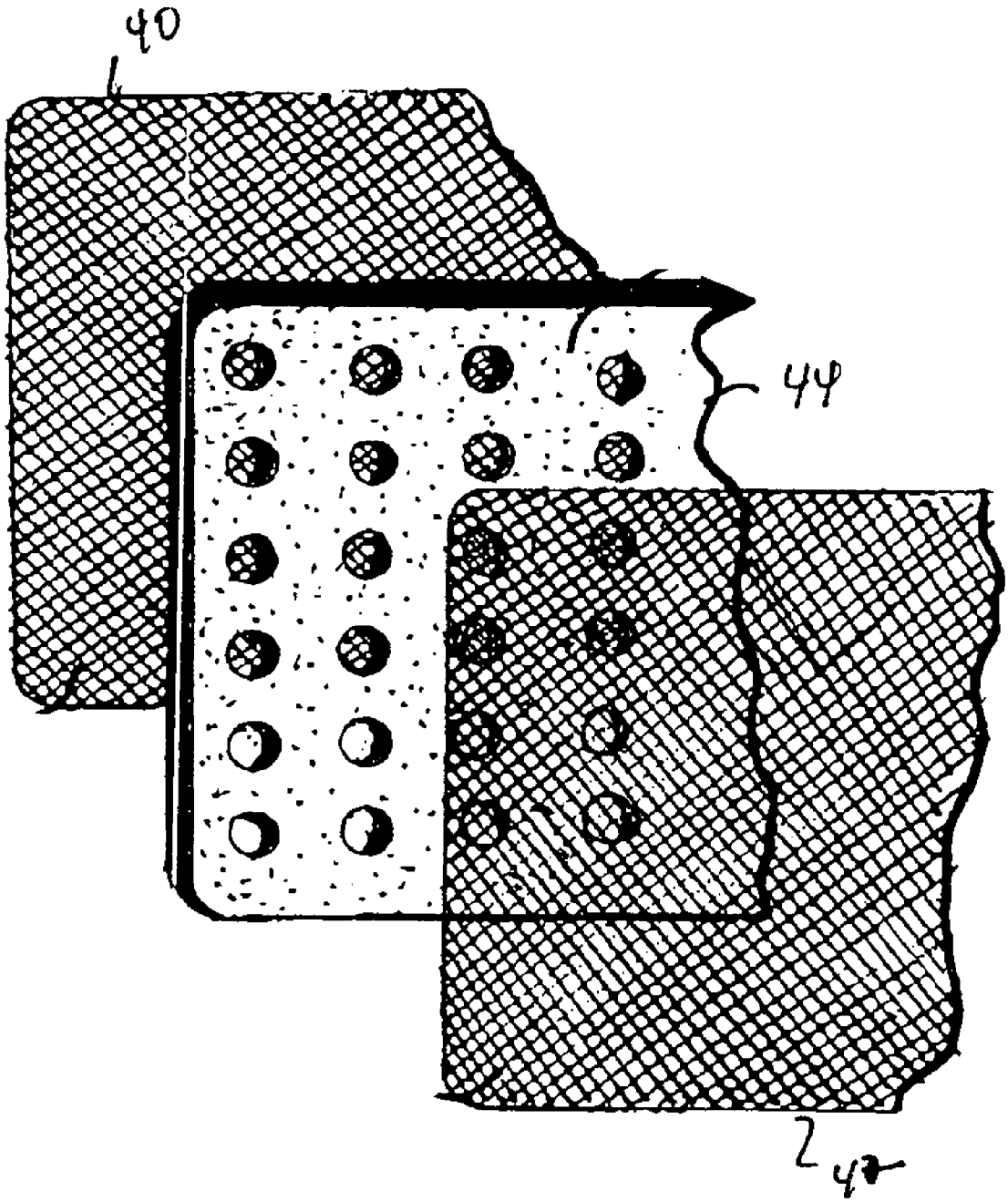
FIG. 6A is a schematic diagram of an arrangement of materials used for forming the hygiene shoe.
Figure 6C:
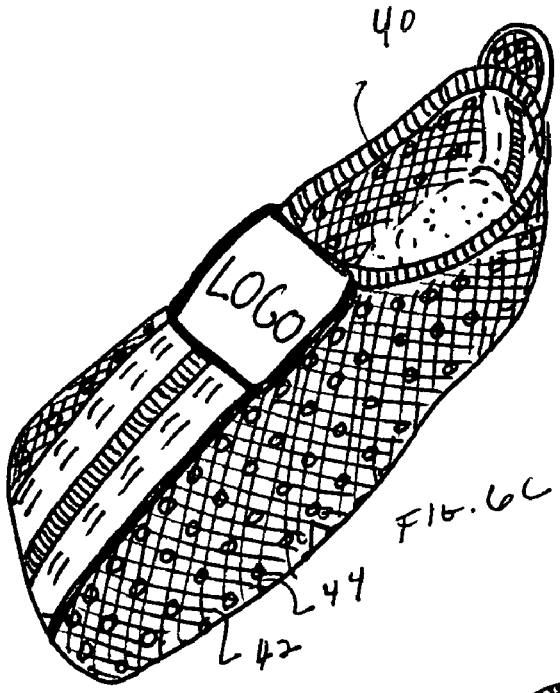
FIG. 6C is a perspective schematic view of the materials of the hygiene shoe.
Figure 6B:
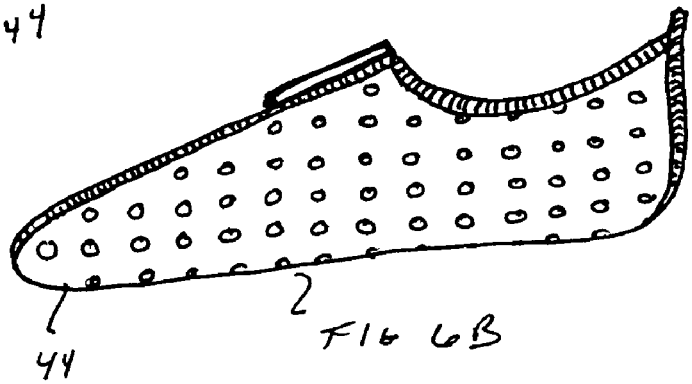
FIG. 6B is a schematic diagram of the hygiene shoe including an inner neoprene layer.

Hygiene shoe 10 is formed of a stretchable form-fitting material for molding to a user's foot. In one embodiment, hygiene shoe 10 can be formed of first outer skin layer 40 formed of a nylon stretch material and second outer skin layer 42 formed of a nylon stretch material, as shown in FIGS. 6A-6C. Inner layer 44 positioned between first outer skin layer 40 and second outer skin later 42 is formed of a neoprene foam material. A plurality of holes 45 can be formed in inner layer 44. For example, holes 45 can have a diameter of about one-eighth of an inch. Hygiene shoe 20 can be formed of a washable material.

Figure 7:
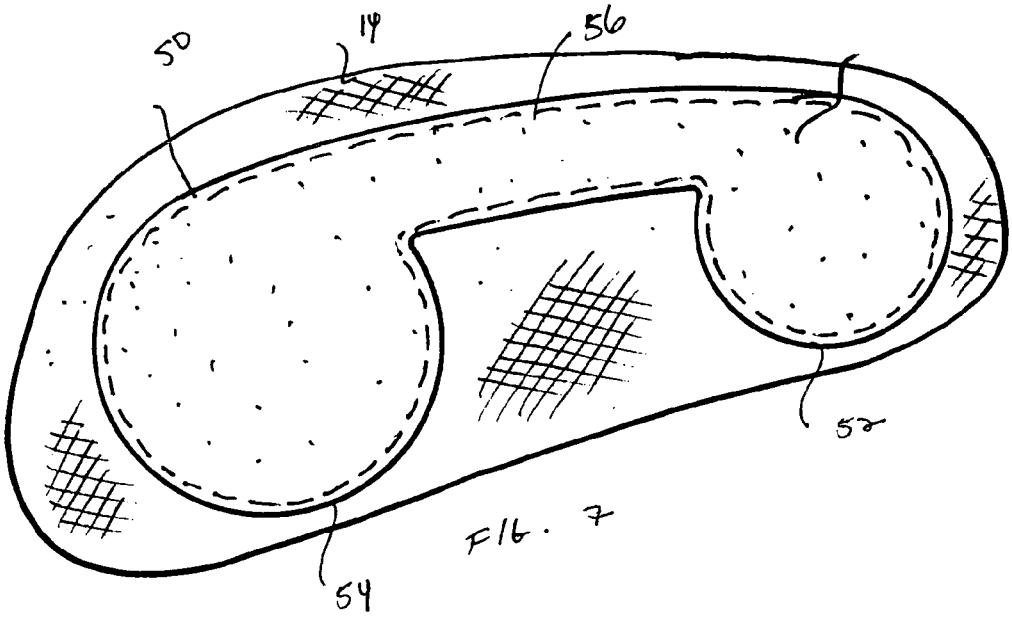
FIG. 7 is a plan view of a bottom portion of the hygiene shoe.

Sole portion 14 can comprise traction portion 50, as shown in FIG. 7. Traction portion 50 can also be formed on inner portion 18 to allow traction portion 50 to be used upon reversing of hygiene shoe 10, as shown in FIG. 4. Referring to FIG. 7, traction portion 50 includes circular portion 52 and circular portion 54 connected by connecting portion 56. Circular portion 52, circular portion 54 and connecting portion 56 can be integral to each other. Circular portion 52 can have dimensions corresponding to a size of a heel of a user of hygiene shoe 10. Circular portion 54 can have dimensions corresponding to a ball of a foot of the user. During use, circular portion 52 is positioned beneath the heel of the user, circular portion 54 is positioned beneath the ball of a foot of the user and connection portion 56 is positioned beneath the outer portion of the foot for providing forward movement, pivoting on the ball and heel of the foot and lateral stability.

Figure 8:
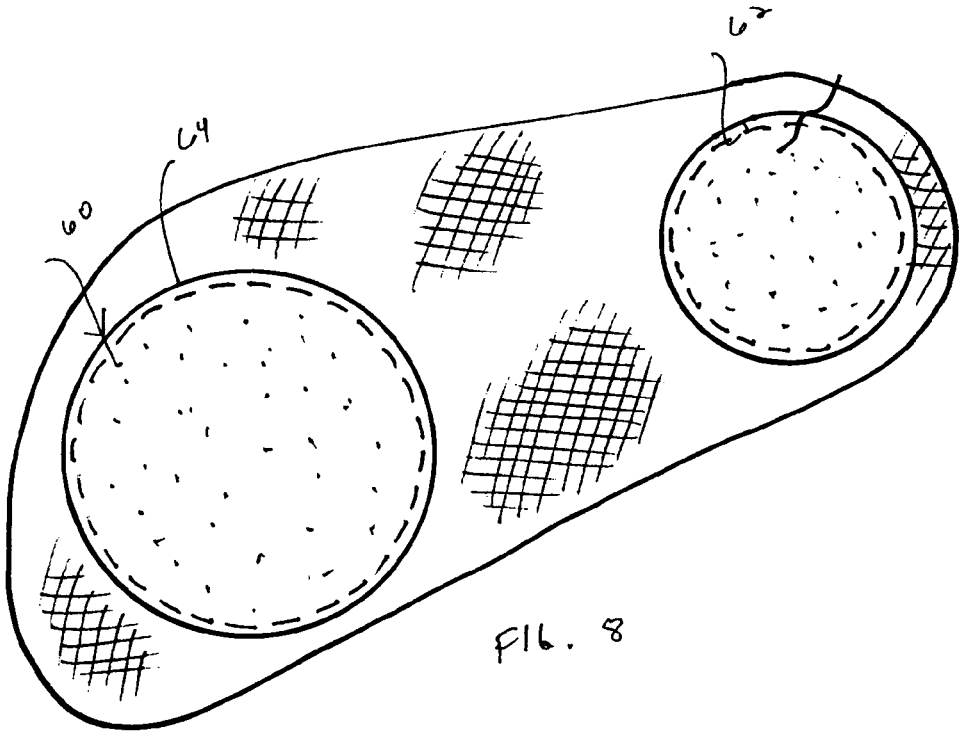
FIG. 8 is a plan view of an alternate embodiment of a bottom portion of the hygiene shoe.
Figure 11:
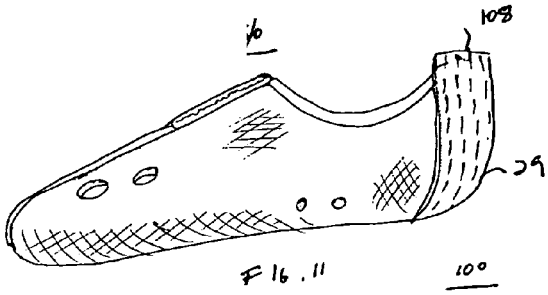
FIG. 11 is a side and elevational view of the hygiene shoe shown in FIG. 10 with belt and tab portions removed.
Figure 12:
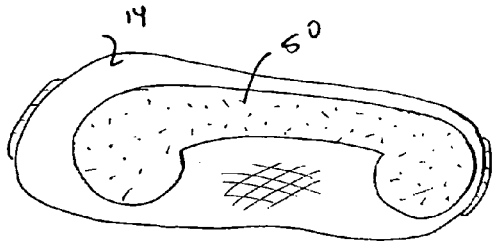
FIG. 12 is a rear view of the hygiene shoe shown in FIG. 10.
Figure 10:
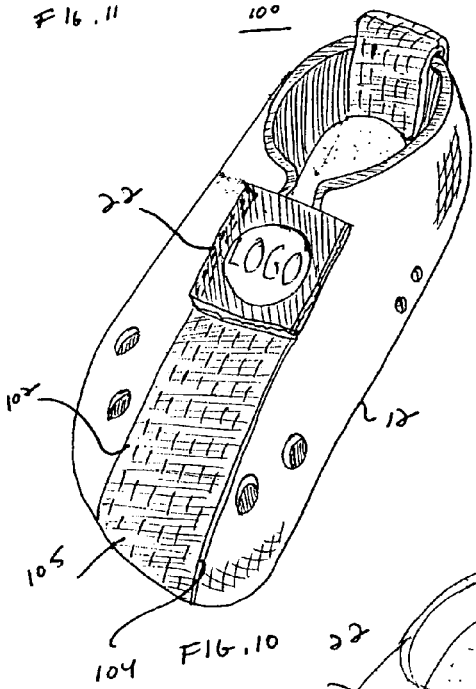
FIG. 10 is a side and top elevational view of an alternate embodiment of the hygiene shoe.

In an alternate embodiment shown in FIG. 8, traction portion 60 is formed of circular portion 62 and circular portion 64. During use, circular portion 62 is positioned beneath the heel of the user and circular portion 64 is positioned-beneath the ball of a foot of the user. Traction portion 50 and traction portion 60 can be formed of a material to provide traction to a martial arts mat surface. For example, traction portion 50 and traction portion 60 can be formed of leather, suede or a synthetic fabric material.

In an alternate embodiment, upper portion 12 of hygiene shoe 70 includes opening 71, as shown in FIGS. 9A and 9B. Opening 71 has a circular or oval shape for slipping on a foot of a user. Restraining band 72 is positioned at top 73 of opening 71. Restraining band 72 can be formed of an elastic material for restraining hygiene shoe 10 against the user. For example, restraining band 72 can be formed of a pair of elastic members 74*a*, 74*b*, positioned on either side of inner band 76, as shown in FIG. 9B. Elastic members 74*a*, 74*b* can be covered with a fabric such as nylon. Inner band 76 can be formed of a fabric such as nylon.

Figure 13B:
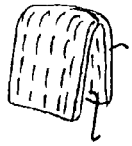
FIG. 13B is a front elevational view of a tab which can be coupled to the hygiene shoe.
Figure 13A:
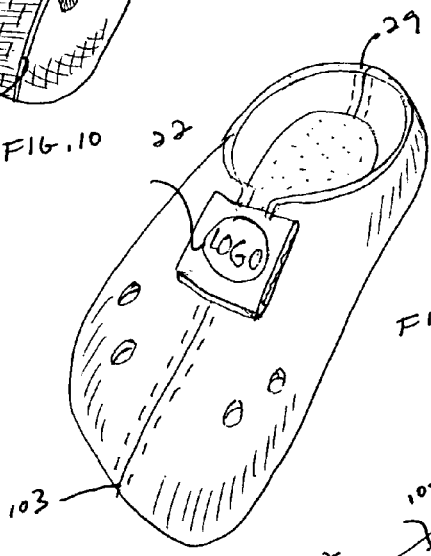
FIG. 13A is a side and elevational view of the hygiene shoe shown in FIG. 10 with belt and tab portions removed.
Figure 13C:
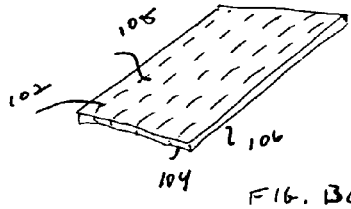
FIG. 13C is a front and side elevational view of a belt portion which can be coupled to the hygiene shoe.

FIGS. 10-13C illustrate an alternate embodiment of hygiene shoe 100. Belt portion 102 is attached with attaching member 104 to upper portion 12. For example, attaching member 104 can be formed of a hook and loop material. Belt portion 102 can be attached over seam portion 103, as shown in FIG. 13A. Belt portion 102 is similar in appearance to a martial arts belt, as shown in FIG. 13C. Belt portion 102 can have a thickness which is less than the thickness of a typical martial arts belt to provide elasticity of hygiene shoe 10. For example, belt portion 102 can have a thickness in a range of about 1 mm to about 2 mm. Belt portion 102 can have an upper surface 105 formed of a material having a color matching a first color of a conventional martial arts belt. For example, upper surface 105 of belt portion 102 can have a color of white, yellow, red, purple, brown, or black. Belt portion 102 can have a bottom surface 106 matching a second color of a conventional martial arts belt. Accordingly, a user can wear hygiene shoe 100 with upper surface 105 of belt portion 102 showing or reverse belt portion 102 with bottom surface 106 of belt showing to match a belt level of martial arts which the user is currently practicing.

Removable tab 108 is attached with attaching member 109 to rear 129 of hygiene shoe 100, as shown in FIG. 13B. Removable tab 108 is similar in appearance to a martial arts belt. Removable tab 108 can have an upper surface 109 formed of a material having a color matching a first color of a conventional martial arts belt. Removable tab 108 can have a bottom surface 110 matching a second color of a conventional martial arts belt. Accordingly, a user can wear hygiene shoe 100 with upper surface 109 of removable tab 108 showing or reverse tab 108 with bottom surface 109 of removable tab 108 showing to match a belt level of martial arts which the user is currently practicing.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A reversible hygiene shoe for use in the martial arts comprising:

an upper portion coupled to a sole portion, said upper portion and said sole portion being formed of a stretchable form-fitting material;

an opening in the upper portion adapted to receive a foot of a user;

a flap extending from a first side of said opening;

a first attachment member attached to said flap;

a second attachment member attached to an opposite side of said opening, wherein said first attachment member can be attached to said second attachment member for closing said opening extension and securing said shoe to a user's foot, wherein an outer portion of the upper portion can be pushed inside an inner portion of said upper portion for reversing said hygiene shoe; and wherein said stretchable form-fitting material is formed of a first outer skin layer of a nylon stretch material, a second outer skin layer of a nylon stretch material and an inner layer positioned between said first outer skin layer and said second outer skin layer, said inner layer being formed of a neoprene foam material for molding to a user's foot.

2. The shoe of claim 1 wherein said outer portion is formed of a first color and said inner portion is formed of a second color.

3. The shoe of claim 2 wherein said first color matches a color of a belt level of martial arts and said second color matches a color of a different belt level of martial arts.

4. The shoe of claim 1 further comprising an opening extension extending from said opening.

5. The shoe of claim 1 wherein said first attachment member and said second attachment member are formed of a hook and loop material.

6. The shoe of claim 1 further comprising holes in said upper portion.

7. The shoe of claim 1 further comprising a tab at a rear of said shoe.

8. The shoe of claim 1 wherein said shoe is formed of a single piece of material.

9. The shoe of claim 1 further comprising a traction portion attached to said sole portion.

10. The shoe of claim 9 wherein said traction portion comprises a first circular portion having dimensions corresponding to a size of a heel of a user of the shoe, a second circular portion having dimensions corresponding to a ball of a foot of the user and a connecting portion connecting said first circular portion and said second circular portion.

11. The shoe of claim 9 wherein said traction portion is formed of leather, suede or synthetic fabric material.

12. The shoe of claim 9 wherein said traction portion comprises a first circular portion having dimensions corresponding to a size of a heel of a user of the shoe and a second circular portion having dimensions corresponding to a ball of a foot of the user.

13. The shoe of claim 12 wherein said traction portion is formed of leather, suede or synthetic fabric material.

14. The shoe of claim 1 further comprising a traction portion attached to said inner portion.

15. The shoe of claim 14 wherein said traction portion comprises a first circular portion having dimensions corresponding to a size of a heel of a user of the shoe, a second circular portion having dimensions corresponding to a ball of a foot of the user and a connecting portion connecting said first circular portion and said second circular portion.

16. The shoe of claim 15 wherein said traction portion is formed of leather, suede or synthetic fabric material.

17. The shoe of claim 14 wherein said traction portion comprises a first circular portion having dimensions corresponding to a size of a heel of a user of the shoe and a second circular portion having dimensions corresponding to a ball of a foot of the user.

18. The shoe of claim 17 wherein said traction portion is formed of leather, suede or synthetic fabric material.

19. The shoe of claim 1 wherein said material is washable.

20. The shoe of claim 1 wherein a height of said upper portion is sufficient for covering an ankle of a wearer when said shoe is in use.

21. The shoe of claim 1 further comprising a restraining band positioned at a top of said opening.

22. The shoe of claim 1 further comprising:

a belt portion and an attaching member, said attaching member attaching said belt portion to said upper portion, said belt portion is similar in appearance to a martial arts belt.

23. The shoe of claim 22 wherein an upper surface of said belt portion is formed of a first color to match a color of a belt level of martial arts and a bottom surface of said belt portion is formed of a second color to match a color of a different belt level of martial arts.

24. The shoe of claim 22 wherein said attaching member is formed of a hook and loop material.

25. The shoe of claim 1 further comprising:

a tab and an attaching member, said attaching member attaching said tab to a rear of said shoe, said tab is similar in appearance to a martial arts belt.

26. The shoe of claim 25 wherein an upper surface of said tab is formed of a first color to match a color of a belt level of martial arts and a bottom surface of said tab is formed of a second color to match a color of a different belt level of martial arts.

* * * * *